US007341067B2

(12) United States Patent
Jones et al.

(10) Patent No.: US 7,341,067 B2
(45) Date of Patent: Mar. 11, 2008

(54) METHOD OF MANAGING THE CLEANING OF HEAT TRANSFER ELEMENTS OF A BOILER WITHIN A FURNACE

(75) Inventors: Andrew Jones, Cincinnati, OH (US); Tim Carlier, Cincinnati, OH (US)

(73) Assignee: International Paper Comany, Memphis, TN (US)

( * ) Notice: Subject to any disclaimer, the term of this patent is extended or adjusted under 35 U.S.C. 154(b) by 0 days.

(21) Appl. No.: 10/950,707

(22) Filed: Sep. 27, 2004

(65) Prior Publication Data

US 2006/0065291 A1 Mar. 30, 2006

(51) Int. Cl.
*B08B 3/00* (2006.01)
*B08B 9/00* (2006.01)

(52) U.S. Cl. ..... 134/22.1; 134/18; 134/30; 134/34; 134/39; 134/42; 122/279

(58) Field of Classification Search ..... 134/18, 134/42, 22.1, 30, 34, 39; 122/279
See application file for complete search history.

(56) References Cited

U.S. PATENT DOCUMENTS

| | | | | |
|---|---|---|---|---|
| 4,454,840 | A | 6/1984 | Dziubakowski | |
| 4,466,383 | A | 8/1984 | Klatt et al. | |
| 4,475,482 | A | 10/1984 | Moss et al. | |
| 4,539,840 | A | 9/1985 | Klatt et al. | |
| 4,718,363 | A | 1/1988 | Williames | |
| 6,323,442 | B1 | 11/2001 | Jones | |
| 6,325,025 | B1 | 12/2001 | Perrone | |
| 6,736,089 | B1 * | 5/2004 | Lefebvre et al. | 122/379 |
| 2004/0006841 | A1 | 1/2004 | Jameel et al. | |
| 2004/0226758 | A1 * | 11/2004 | Jones et al. | 177/142 |

* cited by examiner

*Primary Examiner*—Zeinab El-Arini
(74) *Attorney, Agent, or Firm*—Matthew M. Eslami

(57) ABSTRACT

A method of cleaning a heat transfer element within a boiler furnace is provided. The method includes the steps of allowing a furnace to operate and deposit ash on a heat transfer element, determining an efficiency rate for at least one cleaning element, and managing the cleaning element based on the efficiency rate.

11 Claims, 7 Drawing Sheets

METHOD OF MANAGING THE CLEANING OF HEAT TRANSFER ELEMENTS OF A BOILER WITHIN A FURNACE

BACKGROUND OF THE INVENTION

1. Field of the Invention

The present invention relates to boilers and, in particular, to a method and apparatus for measuring the effectiveness of sootblowers that remove ash deposits on the superheaters of the boilers used with the kraft pulping process.

2. Background Information

In the paper-making process, chemical pulping yields, as a by-product, black liquor, which contains almost all of the inorganic cooking chemicals along with the lignin and other organic matter separated from the wood during pulping in a digester. The black liquor is burned in a boiler. The two main functions of the boiler are to recover the inorganic cooking chemicals used in the pulping process and to make use of the chemical energy in the organic portion of the black liquor to generate steam for a paper mill. The twin objectives of recovering both chemicals and energy make boiler design and operation very complex. As used herein, a "boiler" indicates a top supported boiler that, as described below, burns a fuel which fouls the heat transfer surfaces.

In a kraft boiler, superheaters are placed in the upper furnace in order to extract heat by radiation and convection from the furnace gases. Saturated steam enters the superheater section, and superheated steam exits at a controlled temperature. The superheater is constructed of an array of tube panels. The superheater surface is continually being fouled by ash that is being carried out of the furnace chamber. The amount of black liquor that can be burned in a kraft boiler is often limited by the rate and extent of fouling on the surfaces of the superheater. This fouling with deposited ash reduces the heat absorbed from the liquor combustion, resulting in low exit steam temperatures from the superheaters and high gas temperatures entering the boiler. Boiler shutdown for cleaning is required when either the exit steam temperature is too low for use in downstream equipment or the temperature entering the boiler bank exceeds the melting temperature of the deposits, resulting in gas side pluggage of the boiler bank. In addition, eventually fouling causes plugging, and in order to remove the plugging, the burning process in the boiler has to be stopped. A plugged boiler typically means at least a twenty-four hour shutdown for the entire production unit, which causes great economic losses for the entire pulp mill. Kraft boilers are particularly prone to the problem of superheater fouling, due to the high quantity of ash in the fuel (typically more than 35%) and the low melting temperature of the ash.

There are three conventional methods of removing ash deposits from the superheaters in kraft boilers, listed in increasing order of required downtime and decreasing order of frequency: 1) sootblowing; 2) chill-and-blow; and 3) waterwashing. This application addresses only the first of these methods, sootblowing. Sootblowing is the process of blowing deposited ashes off the superheater with a blast of steam from nozzles called sootblowers. Sootblowing occurs essentially continuously during normal boiler operation, with different sootblowers turned on at different times. Sootblowing is usually carried out using steam, the steam consumption of a sootblowing procedure typically being 4-5 kg/s, which corresponds to about 4-5% of the steam production of the entire boiler; the sootblowing procedure thus consumes a large amount of thermal energy.

At its simplest, sootblowing is a procedure known as sequence sootblowing, wherein sootblowers operate at determined intervals in an order determined by a certain predetermined list. The sootblowing procedure runs at its own pace according to the list, irrespective of whether sootblowing is needed or not, which means that plugging cannot necessarily be prevented even if the sootblowing procedure consumes a high amount of steam. Each sootblowing operation reduces a portion of the nearby ash deposit, but the ash deposit nevertheless continues to build up over time. As the deposit grows, sootblowing becomes gradually less effective and results in impairment of the heat transfer. When the ash deposit reaches a certain threshold where boiler efficiency is significantly reduced and sootblowing is insufficiently effective, deposits may need to be removed by one of the other cleaning processes identified above.

A steam sootblower is, typically, elongated tubes having one or more radial openings at the distal end. The tubes are coupled to a source for pressurized steam. The sootblowers are further structured to move between a first position located outside of the furnace, to a second location within the furnace. As the sootblowers move between the first position and the second position, the sootblower moves adjacent to the heat transfer surfaces. One type of sootblower is structured to move generally perpendicular to the heat transfer surfaces. Another type of sootblower moves generally parallel and in between heat transfer surfaces. To move perpendicular to the heat transfer surfaces, the heat transfer surfaces have passages therethrough. The movement into the furnace, which is typically the movement between the first and second positions, may be identified as a "first stroke" and the movement out of the furnace, which is typically the movement between the second position and the first position, may be identified as the "second stroke." Generally, sootblowing methods use the full motion of the sootblower between the first position and the second position, however, a partial motion may also be considered a first or second stroke. As the sootblower moves adjacent to the heat transfer surfaces, the steam is expelled through the openings. The steam contacts the ash deposits on the heat transfer surfaces and dislodges a quantity of ash; some ash, however, remains. As used herein, the term "removed ash" shall refer to the ash deposit that is removed by the sootblowing procedure and "residual ash" shall refer to the ash that remains on a heat transfer surface after the sootblowing procedure. The steam is usually applied during both the first and second strokes.

Rather than simply running the sootblowers on a schedule, it is desirable to actuate the sootblowers when the ash buildup reaches a predetermined level. One method of determining the amount of buildup of ash on the heat transfer surfaces within the furnace is to measure the weight of the heat transfer surfaces and associated superheater components. The method of determining the weight of the deposits is disclosed in U.S. Pat. No. 6,323,442, which is incorporated herein by reference. It is further desirable to conserve energy by having the sootblowers use steam only when the steam is effectively cleaning the heat transfer surfaces.

There is, therefore, a need for a method of cleaning the heat transfer surfaces of furnace superheater components when the heat transfer surfaces attain a predetermined level of fouling.

There is a further need for a method of cleaning the heat transfer surfaces of furnace superheater components that only utilizes steam during an effective portion of the cleaning procedure.

SUMMARY OF THE INVENTION

These needs, and others, are met by the present invention which provides a method of cleaning the heat transfer surfaces of a heat transfer element in a furnace superheater when the heat transfer surfaces attain a predetermined level of fouling as determined by the weight of the ash. This invention further provides a method of managing the cleaning system based on the efficiency of the cleaning system or a cleaning element. The weight of the ash is, preferably, determined using a weighing system coupled to the support structure supporting the heat transfer surface. Typically, the heat transfer surfaces hang from rods and the weighing system includes at least one weighing device, such as, but not limited to, a strain gage or load cell, coupled to the hanger rods. While a preferred weighing system is structured to determine the weight on each hanger rod, the weighing system with a more limited number of weighing device may also be used. That is, for example, a weighing system having a limited number of weighing devices may be structured to measure torque in order to determine the weight of the ash. Accordingly, the weighing system is said to measure the "force," as opposed to simply the weight, applied on the support structure by the heat transfer element and the ash deposited thereon.

By measuring the force applied to the support structure by the heat transfer elements when the heat transfer elements are clean, e.g. when newly installed or after waterwashing, an initial force may be determined. While the furnace is in use, the heat transfer elements will become fouled with ash. The weight of the ash creates an additional force. Each heat transfer element can support a maximum amount of ash before the use of the heat transfer element becomes inefficient. A cleaning system is used to remove the ash to delay buildup of ash to the maximum limit. If the cleaning system cannot remove a sufficient amount of ash, and the heat transfer elements remain above the maximum amount of ash after cleaning, the furnace may need to be cleaned using the chill-and-blow or waterwashing methods noted above. Additionally, the cleaning system has a plurality of cleaning elements. Each cleaning element has a known efficiency rate at which the cleaning element is expected to operate. That is, for each cleaning element, a known quantity of ash is expected to be removed during a cleaning operation. If this quantity of ash is not removed, the cost of operating the cleaning element is not justified by the amount of ash being removed. Thus, if the cleaning element does not achieve the minimally acceptable efficiency rate, use of that element is reduced so that steam is not wasted on an inefficient cleaning element.

The cleaning system is used to clean the heat transfer elements when a predetermined force is reached, and/or, the cleaning system may be used on a schedule. Regardless of the event that initiates cleaning, the weighing system is used to determine a first force representing the force created by the heat transfer elements and the ash. The cleaning system, which is preferably at least two steam sootblowers, is operated to remove the ash. After the cleaning system is operated, the weighing system is used to determine a second force representing the force created by the heat transfer elements and the residual ash. By comparing the first force and the second force, the amount of ash removed by a specific cleaning element may be determined. The ratio of the weight of the ash before and after cleaning is used to determine an efficiency rate for each cleaning element. Based on this information, use of the cleaning elements may be managed to promote efficient cleaning. That is, if it is determined that a specific cleaning element is not removing a sufficient quantity of ash, that cleaning element may have additional steam delivered thereto, have an additional cleaning stroke performed or be disabled.

The management of a cleaning element may be based on several factors. For example, the measurement may be a relative measurement. That is, for example, if two cleaning elements are cleaning a single heat transfer element, and it is determined that one of the cleaning elements is performing more efficiently that the other, the less efficient cleaning element may be disabled. Alternatively, an efficiency rate for each cleaning element may be determined over the course of time by recording the amount of ash deposits removed by each cleaning procedure. Alternatively, the cleaning element may be designed with an intended cleaning ability or efficiency rate. Where there is a minimum efficiency rate, the efficiency rate of a cleaning element in use is compared to the minimum efficiency rate to determine if the cleaning element will be used again. Additionally, where there are multiple cleaning elements, the weighing system is used to identify a change in force, and thus an efficiency rate, associated with each cleaning element. That is, for example, where there are two heat transfer elements and a single cleaning element associated with each heat transfer element, the weighing system could be structured to determine the change in weight of each heat transfer element. Thus, the weighing system may be used to determine the efficiency rate of each cleaning element. When one of the cleaning elements fall below the minimum efficiency rate, only the use of that cleaning element is disabled. The concept of this simple example may also be applied to complex configurations wherein multiple weighing devices are coupled to multiple heat transfer elements which are cleaned by multiple cleaning elements and the weighing system utilizes multiple weighing devices to determine the efficiency of the separate cleaning elements.

In a more preferred embodiment, the efficiency of each cleaning element is determined during, or provided for, a first stroke and a second stroke. That is, the step of cleaning includes a first stroke wherein the cleaning elements move between a first position and a second position, and a second stroke wherein the cleaning elements move from the second position back to the first position. In this embodiment, each cleaning element has a known minimum full cycle efficiency rate, a known minimum first stroke efficiency rate, and a known minimum second stroke efficiency rate. The minimum full cycle efficiency rate relates to the amount of ash expected to be removed after the complete cleaning cycle, that is, both first and second strokes. The minimum first stroke efficiency rate relates to the amount of ash expected to be removed after the first stroke. The minimum second stroke efficiency rate relates to the amount of ash expected to be removed after the second stroke. There may also be a minimum provisional second stroke efficiency rate which relates to the amount of ash expected to be removed after the second stroke when the application of steam during the first stroke has been eliminated.

As before, a first force is determined before the cleaning operation begins. The second force is determined after the first stroke and a third force is determined at the end of the second stroke. By comparing the first and second forces, a first stroke efficiency rate may be determined. By comparing the second and third forces, a second stroke efficiency rate may be determined. By comparing the first and third forces, a full cycle efficiency rate may be determined. If the first stroke efficiency rate is below the minimum first stroke efficiency rate, the application of steam during the first stroke may be eliminated for a number of cleaning cycles. If the second stroke efficiency rate is below the minimum second stroke efficiency rate, the application of steam during the second stroke may be eliminated for a number of cleaning cycles. If the full cycle efficiency rate is below the minimum full cycle efficiency rate, the use of the associated cleaning element may be terminated. Additionally, if the application of steam during the first stroke has been eliminated but steam is still being applied during the second stroke, the provisional second stroke efficiency rate may be determined by comparing the first and third forces. If the provisional second stroke efficiency rate is below the minimum provisional second stroke efficiency rate, the application of steam during the second stroke may be eliminated for a number of cleaning cycles.

Initially, the cleaning system is expected to provide sufficient cleaning during a single stroke. Thus, if most of the ash is removed during the first stroke, the second stroke is likely to remove only a small amount of ash and thus fall below the minimum second stroke efficiency rate. Alternatively, the cleaning element may be operated on the second stroke only as discussed below. Where the cleaning system is a plurality of steam sootblowers, typically the steam will be applied only during the first stroke wherein the sootblowers are moving into the furnace. As the heat transfer surfaces become more fouled with ash, the use of steam during the second stroke may become required. Alternatively, the sootblower may be structured to initially apply steam only during the second stroke. When the second stroke fails to remove a sufficient quantity of ash, the first stroke may be activated during the next cleaning procedure. Hereinafter, a stroke during which steam is applied shall be referred to as an active stroke and a stroke during which steam is not applied shall be referred to as an inactive stroke. If steam is applied during both strokes, the procedure shall be referred to as a full cycle. If steam is not to be applied, the sootblower will be said to be "disabled." In operation, a sootblower may be mechanically linked to another sootblower. Thus, a sootblower with no active stroke may still be moved into and out of the furnace.

Thus, the cleaning system may be structured to initially utilize a cleaning element with an inactive stroke then, as the residual ash builds up, activate the inactive stroke of the cleaning element when the active stroke falls below the minimum efficiency rate for that stroke. Alternatively, the inactive stroke may be activated after a set number of cycles. It must be further understood that the removal of ash does not always progress in standard fashion. That is, although one cleaning stroke or full cycle of cleaning may fail to remove an effective quantity of ash, this does not always indicate that a later cleaning stroke or full cycle will also fail to remove an effective amount of ash. Thus, it is possible that the management of the cleaning system will include reactivating disabled cleaning elements. Eventually, however, the use of steam during both the first and second strokes may consistently fail to remove the required amount of ash and the cleaning element will fall below the minimum full cycle efficiency rate and use of the cleaning element will be disabled.

Because the first stroke efficiency may be determined during the cleaning cycle, it is preferred to have the first stroke be the initial active stroke. That is, if it is determined that the first stroke failed to remove a sufficient quantity of ash, the second stroke may be activated in the middle of the cycle and the heat transfer element will have the benefit of the second stroke cleaning. If the second stroke is the initial active stroke and it fails to remove a sufficient quantity of ash, the heat transfer element will remain with the excessive ash deposit until the next cleaning cycle when the first stroke may be activated. In the circumstance where the second stroke is the initial active stroke, the stroke is identified as a provisional second stroke. As before, once the provisional second stroke efficiency rate falls below the minimum provisional second stroke efficiency rate, the application of steam may be activated on the first stroke in an effort to bring the cleaning element full cycle efficiency rate up to the minimum full cycle efficiency rate.

Accordingly, it is an object of this invention to provide a method of cleaning the heat transfer surfaces of furnace superheater components when the heat transfer surfaces attain a predetermined level of fouling.

It is another object of this invention to provide a method of cleaning the heat transfer surfaces of furnace superheater components that only utilizes steam during an effective portion of the cleaning procedure.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, the word "disabled" when used to describe a steam sootblower shall indicate that the supply of steam to that sootblower has been turned off, or reduced significantly.

As used herein, the word "manage" when applied to the cleaning system, a cleaning element, or cleaning elements shall mean the selective use/activation of a cleaning element or elements. Further, when applied to a steam sootblower, the word "manage" shall mean the selective supply of the amount of steam to a steam sootblower.

As used herein, the word "supplied" when applied to an efficiency rate shall mean that the efficiency rate is based on design factors known about the cleaning elements or cleaning system.

As used herein, the word "determining" when applied to an efficiency rate shall mean that the efficiency rate is based on data collected during the use of the cleaning elements or cleaning system.

As used herein, the word "provided" when applied to an efficiency rate shall mean that the efficiency rate is either supplied or determined.

Figure 1:
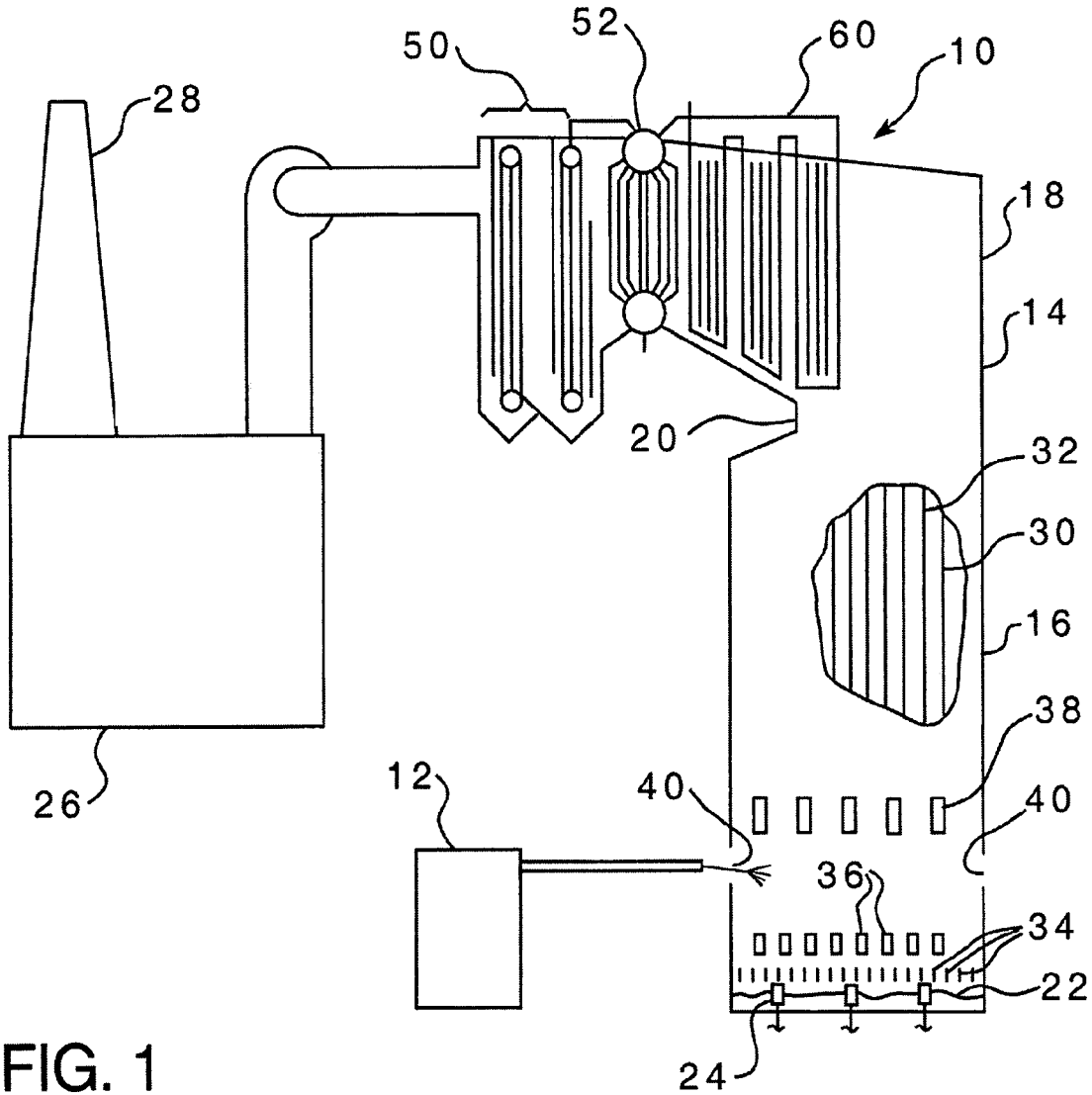
FIG. 1 diagrammatically shows the components of a typical kraft black liquor boiler system.

FIG. 1 diagrammatically shows the components of a typical kraft black liquor boiler system 10. Black liquor is a by-product of chemical pulping in the paper-making process and which is burned in the boiler system 10. The initial concentration of "weak black liquor" is about 15%. The black liquor is concentrated to firing conditions (65% to 85% dry solids content) in an evaporator 12, and then burned in a boiler 14. The boiler 14 has a furnace section, or "furnace" 16, where the black liquor is burned, and a convective heat transfer section 18, with a bullnose 20 in between. Combustion converts the black liquor's organic material into gaseous products in a series of processes involving drying, devolatilizing (pyrolyzing, molecular cracking), and char burning/gasification. Some of the liquid organics are burned to a solid carbon particulate called char. Burning of the char occurs largely on a char bed 22 which covers the floor of the furnace 16, though some char burns in flight. As carbon in the char is gasified or burned, the inorganic compounds in the char are released and form a molten salt mixture called smelt, which flows to the bottom of the char bed 22, and is continuously tapped from the furnace 16 through smelt spouts 24. Exhaust gases are filtered through an electrostatic precipitator 26, and exit through a stack 28.

The vertical walls 30 of the furnace 16 are lined with vertically aligned wall tubes 32, through which water is evaporated from the heat of the furnace 16. The furnace 16 has primary level air ports 34, secondary level air ports 36, and tertiary level air ports 38 for introducing air for combustion at three different height levels. Black liquor is sprayed into the furnace 16 out of black liquor guns 40.

The heat transfer section 18 contains three sets of tube banks (heat traps) which successively, in stages, heat the feedwater to superheated steam. The tube banks include an economizer 50, in which the feedwater is heated to just below its boiling point, a boiler bank 52, or "steam generating bank," in which, along with the wall tubes 32, the water is evaporated to steam, and a superheater system 60, which increases the steam temperature from saturation to the final superheat temperature.

Figure 2:
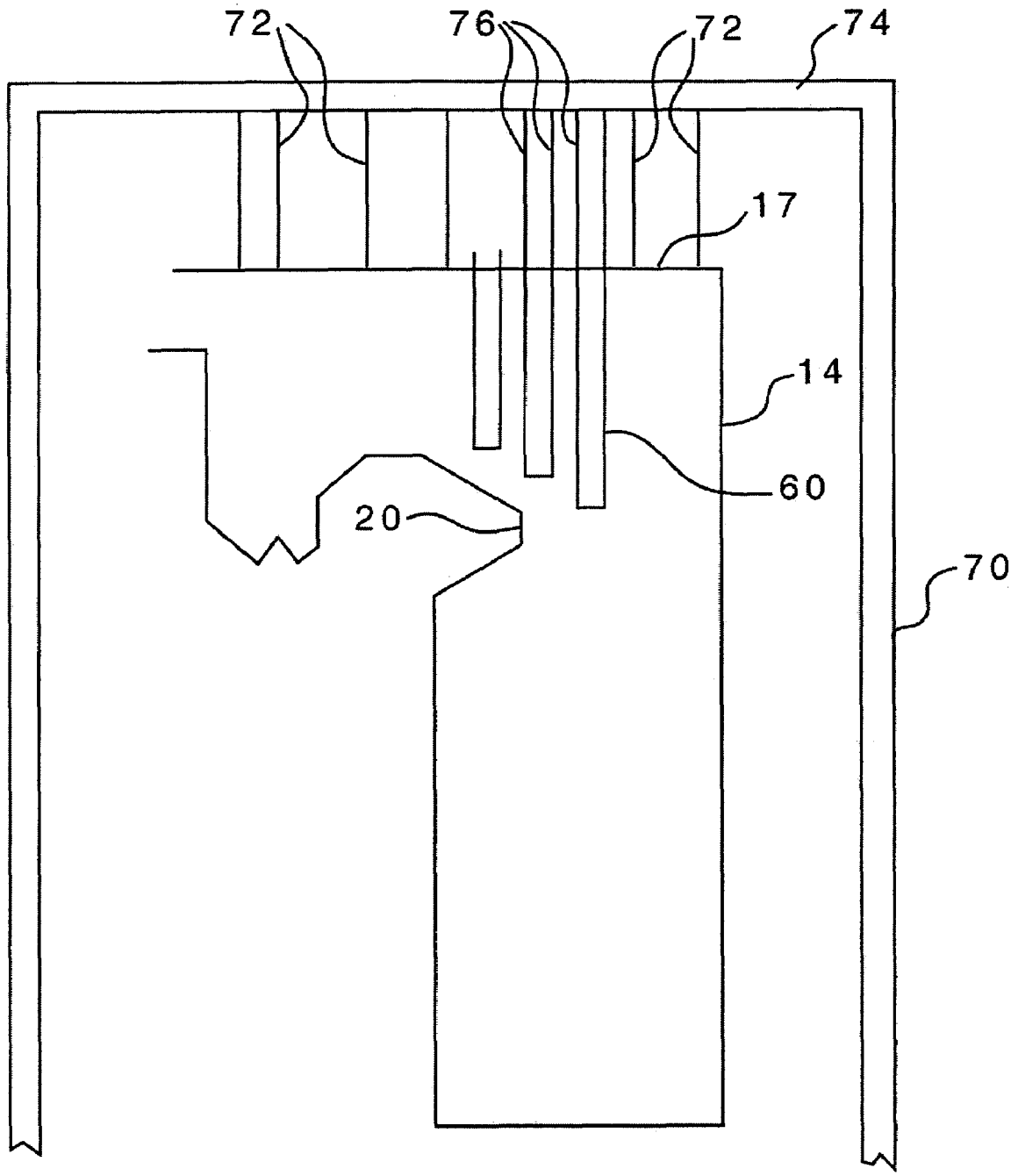
FIG. 2 diagrammatically illustrates how the boiler is mounted in a steel beam support structure.

FIG. 2 diagrammatically illustrates how the boiler system 10 is mounted in a steel beam support structure 70, showing only the boiler system's profile and components that are of current interest. The entire boiler system 10 is suspended in the middle of the support structure 70 by boiler hanger rods 72. The boiler hanger rods 72 are connected between the roof 17 of the boiler system 10 and the overhead beams 74 of the support structure 70. Another set of hanger rods, hereinafter called "superheater hanger rods" or simply "hanger rods" 76, suspend only the superheater system 60. That is, the superheater system 60 is suspended independently from the rest of the boiler system 10.

Figure 3:
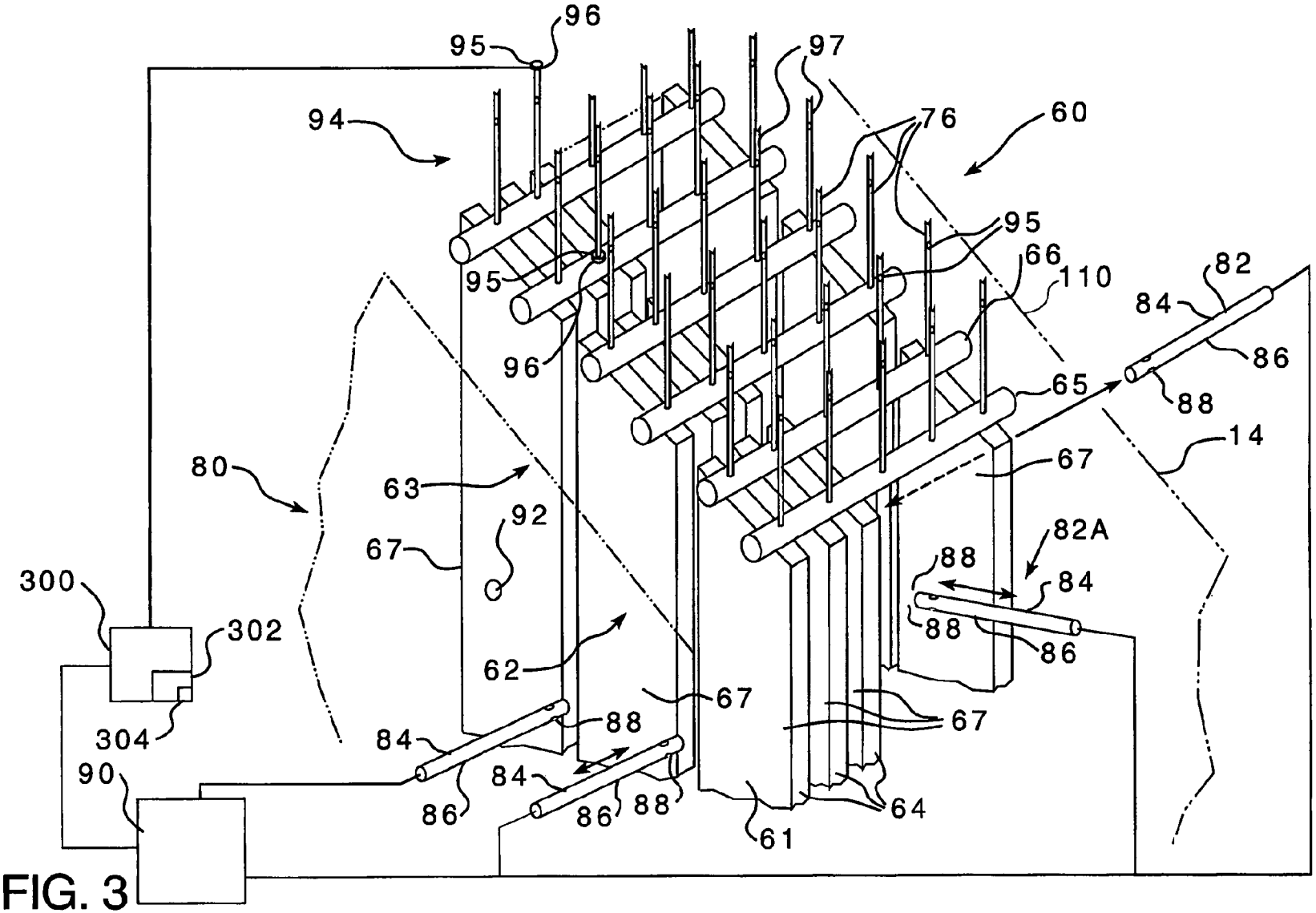
FIG. 3 diagrammatically shows some of the components of the superheater system and a cleaning system.

FIG. 3 diagrammatically illustrates some of the components of the superheater system 60 which are independently suspended within the boiler system 10. The superheater system 60, in this embodiment, has three superheaters 61, 62, 63. While three superheaters are shown, it is within the terms of the invention to incorporate more or less superheaters as needed. For clarity, the following discussion describes the construction of superheater 61 or speaks in terms of superheater 61, with the understanding that the construction of the other superheaters 62, 63 is the same. Each superheater 61, 62, 63 is an assembly having at least one, and preferably 20-50, heat transfer elements 64. Steam enters the heat transfer elements 64 through a manifold tube called an inlet header 65. Steam is superheated within the heat transfer elements 64, and exits the heat transfer elements as superheated steam through another manifold tube called an outlet header 66. The heat transfer elements 64 are suspended from the headers 65, 66, which are themselves suspended from the overhead beams 74 (FIG. 2) by hanger rods 76. Typically, 10-20 hanger rods 76 are evenly spaced along the length of each header 65, 66. For example, a superheater 61 may be supported by 20 hanger rods 76; ten hanger rods 76 coupled to the inlet header 65 and ten hanger rods 76 coupled to the outlet header 66.

The outer surface, or heat transfer surface 67, of each heat transfer element 64 is exposed to the interior of the furnace 16. Thus, virtually all parts of the heat transfer surface 67 is likely to be coated with ash during normal operation of the furnace 16. A substantial portion of the heat transfer surfaces 67 are cleaned, that is, have a portion of ash removed, by a cleaning system 80. The cleaning system 80 includes at least one, and preferably a plurality of, cleaning element(s) 82 structured to clean the heat transfer elements 64 and, more specifically, the heat transfer surfaces 67. Preferably, the cleaning elements 82 are steam sootblowers 84, hereinafter "sootblowers," which are known in the art. Sootblowers 84 are elongated tubes 86 having at least one opening 88, and, preferably, a pair of radial openings 88 about 180 degrees apart at the distal tip of the tube 86. The tubes 86 are in fluid communication with a steam source 90. Preferably, the steam is supplied at a pressure of between about 200 to 400 psi. Thus, steam may be expelled through the openings 88 and onto the heat transfer surfaces 67. The sootblowers 84 are structured to move between a first position, typically outside the furnace 16, and a second position, adjacent to the heat transfer elements 64. The inward motion, between the first and second positions, is called a first stroke and the outward motion, between the second position and the first position, is called the second stroke.

As shown on FIG. 3, the sootblowers 84 are, preferably, structured to move generally perpendicular to and in between the heat transfer elements 64. As shown on the right side of FIG. 3, the cleaning elements 82A may also be structured to move generally parallel to and in between the heat transfer elements 64. As shown on the left side of FIG. 3, the sootblowers 84 may also be structured to move generally perpendicular to the heat transfer elements 64 and through a plurality of tubular openings 92 within the heat transfer elements 64. That is, the heat transfer elements 64 are sealed and the sootblowers 84 may pass freely through the tubular openings 92. As the sootblowers 84 move between the first and second positions, steam is expelled via openings 88. As the steam contacts the ash coated on the heat transfer surfaces 67, a portion of the ash is removed. Over time, the buildup of residual ash may become too resilient to be removed by the sootblowers 84 and an alternate cleaning method may be used. The sootblowers 84 described above utilize steam, it is noted however, that the invention is not so limited and the sootblowers may also be based on another principle, such as acoustic sootblowing or another principle enabling sootblowing while the boiler 14 is being used.

The boiler system 10 further includes a weighing system 94. The weighing system 94 is structured to determine the force applied by the heat transfer elements 64 on the support structure 70 and convert that force into an output signal representative of the force. The weighing system 94 includes a plurality of weighing devices 95. The weighing devices 95 are preferably load cells 96 or strain gages 97. The weighing devices 95 are coupled to the hanger rods 76 supporting the heat transfer elements 64. The weighing devices 95 are generally configured to determine the weight of the heat transfer elements 64 and are, preferably, disposed on each hanger rod 76. However, the weighing devices 95 may also be configured to measure other forces, such as, but not limited to, torque. The force applied to the support structure 70 increases as ash deposits build up and is reduced during cleaning. As described below, any step relating to the determination of a force implies that the weighing system 94 is used to determine that force.

Operation of the cleaning system 80 is controlled by a control system 300 which is structured to manage the cleaning system 80 based on the weight of the ash deposits on a heat transfer element 64. The control system 300 is structured to activate the insertion and removal of the sootblowers 84, that is, movement between the sootblowers' 84 first and second position, speed of travel, and the application and/or quantity of steam. That is, steam may be applied on the first, second, or both strokes. Moreover, the steam may be supplied anywhere from zero to one hundred percent of the maximum quantity that the sootblower 84 is structured to deliver. Thus, the control system 300 may be used to manage the cleaning elements 82. The control system 300 may also receive input from the weighing system 94. The control system 300 may utilize and/or display the output signal from the weighing system. The management of the cleaning elements 82 may be manual, that is a user adjusting the utilization of the cleaning elements 82 based on displayed data, or may be automatic. Typically, the control system 300 will utilize one or more programmable logic controllers 302 that have been programmed to manage the cleaning elements based upon the minimum efficiency rates. That is, for example, the programmable logic controller 302 is structured to receive and record the output signal from the weighing system 94, to actuate the cleaning system 80, and, by receiving the output signal and actuating the cleaning system 80, determining the efficiency rate, as described below, for a cleaning element 82 and displaying the efficiency rate for that cleaning element 82. In a preferred embodiment, the programmable logic controller 302 has a data structure 304 representing the minimum efficiency rate, as described below, for a cleaning element 82. The programmable logic controller 302 is structured to disable the cleaning element 82 when the efficiency rate for the cleaning element 82 falls below the minimum efficiency rate for the cleaning element 82. In a more preferred embodiment, the programmable logic controller 302 has a data structure 304 representing the active stroke minimum efficiency rate, as described below, a cleaning element 82 and the full cycle minimum efficiency rate, as described below, for a cleaning element 82. The programmable logic controller 302 is structured to activate cleaning during the non-active stroke when the active stroke efficiency rate falls below the active stroke minimum efficiency rate and to disable the cleaning element 82 when the full cycle efficiency rate for that cleaning element 82 falls below the full cycle minimum efficiency rate for that cleaning element 82.

The use of steam to clean heat transfer elements 64 is expensive. Therefore, it is desirable to only apply steam when that steam is being used effectively to remove ash. To increase the efficiency of the cleaning system 80, the following method is provided. For clarity, the discussion below will address a single heat transfer element 64, however, it is understood that one or more heat transfer elements 64, or groups of heat transfer elements 64, may be cleaned at one time.

Figure 4:
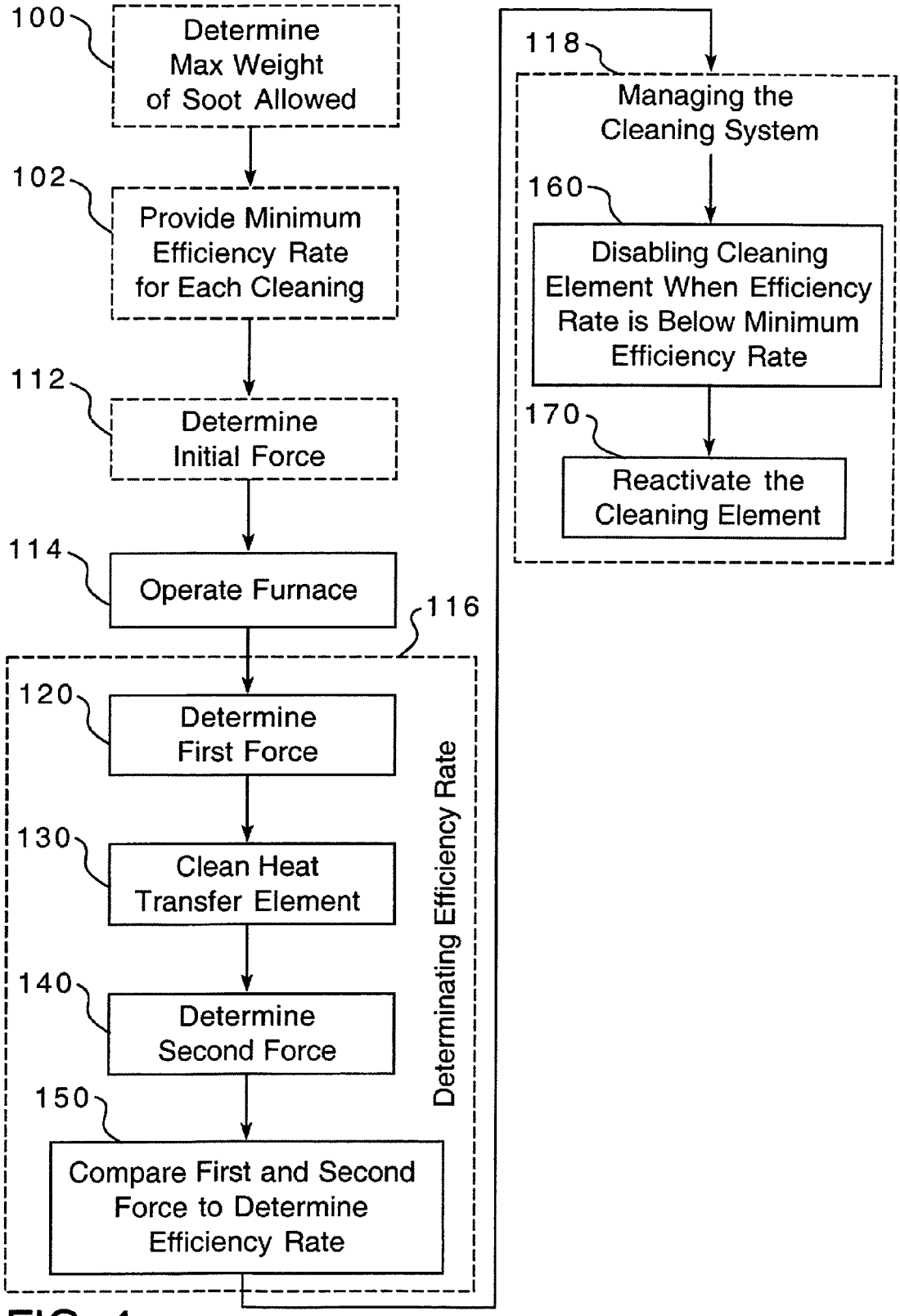
FIG. 4 is a flow chart showing the steps of the method provided.

As shown in FIG. 4, a first step may be supplying or determining the operating limitations for the boiler system 10. Thus, the maximum weight of ash allowable on a heat transfer element 64 is provided 100. Further the minimum efficiency rate for each cleaning element 82 is provided 102. The minimum efficiency rate for each cleaning element 82 may be supplied by design specifications or may be determined by actual use of the cleaning elements 82 over a period of time while gathering data on ash build-up and heat transfer.

Figure 5:
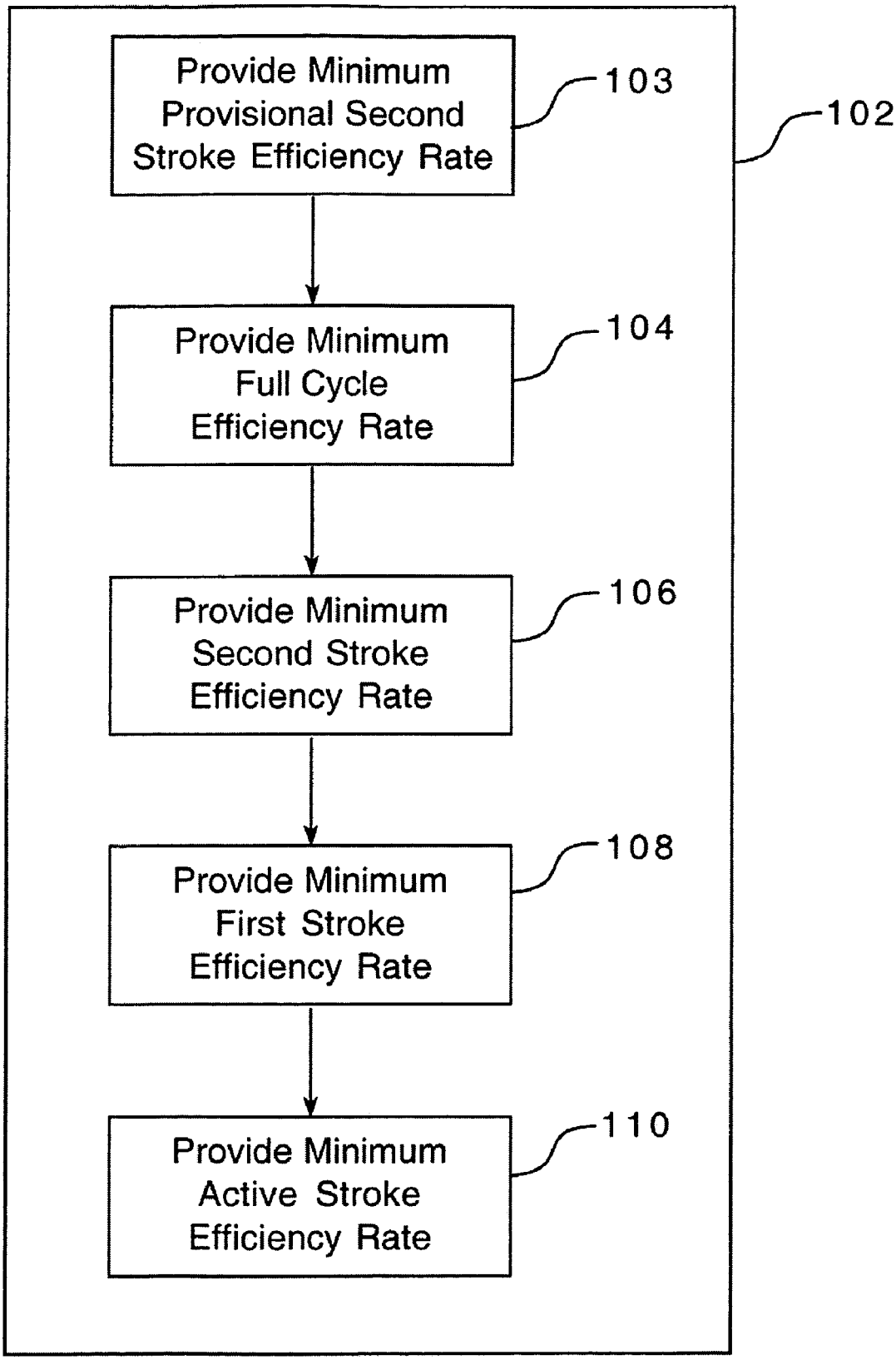
FIG. 5 is a flow chart showing sub-steps to the method provided.

As used herein, the "efficiency rate" of a cleaning element 82 is determined by comparing the force on the support structure 70 before cleaning to the force of the support structure 70 after cleaning to estimate the amount of ash removed. Accordingly, the minimum efficiency rate is a predetermined value representing the efficiency that the cleaning element 82 must achieve in order to justify the expense of using the steam in that element. Additionally, each cleaning element 82 may have efficiency rates for each part of the cleaning cycle. That is, as shown in FIG. 5, the step of providing 102 a minimum efficiency rate for each cleaning element 82 may include the steps of providing an active stroke minimum efficiency rate 103, a first-stroke minimum efficiency rate 104, providing a second stroke minimum efficiency rate 106, and providing a full cycle minimum efficiency rate 108. Additionally, a minimum provisional second stroke efficiency rate is provided 110. The provisional second stroke efficiency rate relates to the amount of ash expected to be removed during the second stroke when the second stroke is the only active stroke.

Another initial step may be providing the initial force 112 applied by the heat transfer element 64 on the support structure 70. The initial force is determined 112 when the heat transfer elements 64 are clean, e.g., when newly installed or after waterwashing. After these initial parameters are determined, the furnace 16 is operated 114. Operation of the furnace 114 causes ash to be deposited on the heat transfer element 64. Eventually, the ash must be removed using the cleaning system 80. The start of the cleaning procedure 130 may be determined by the passage of time or upon the determination that weight of the ash exceeds the maximum weight of ash allowable. The cleaning procedure 130 is also a part of the step of determining the efficiency 116 of the cleaning system 80 or a cleaning element 82. The determination of the efficiency 116 of the cleaning system 80 or a cleaning element 82 includes the following steps.

A first force is determined 120 representing the force of a heat transfer element 64 and any ash coated thereon. It is noted that, as the load cells 96 and strain gages 97 are known to have "noise" which interferes with accurate readings at various points in time, the force on the support structure 70 may be measured over time so that a linear correlation of the weight versus time may be created. Such a correlation may be used to more accurately reflect the force being applied by the support structure 70. Thus, while any specific measurement of force may be based on a single measurement at a single point in time, it is preferred that any force measurement is an average force measured over time. After the first force is determined 120, the heat transfer element is cleaned 130 using the cleaning system 80. The step of cleaning 130 may have additional sub-steps as described below. After the step of cleaning 130, a second force is determined 140 representing the force of a heat transfer element 64 and any residual ash coated thereon. The first force and the second force are compared 150 to determine the efficiency rate of each cleaning element 82.

After the determination of the efficiency 116 of the cleaning system 80 or a cleaning element 82, a user manages 118 the cleaning system 80 to economize the use of energy. Where the cleaning elements 82 are sootblowers 84, such management may include increasing or decreasing the quantity of steam delivered to a selected sootblower 84, disabling either the first or second stroke, disabling the sootblower 84 altogether, or reactivating a disabled sootblower 84. In a furnace 16 where the cleaning elements 82 are provided with a minimum efficiency rate, management 118 of the cleaning system may include the step of disabling 160 a cleaning element 82 when the efficiency rate for that cleaning element 82 is below the minimum efficiency rate for that cleaning element 82.

Figure 6:
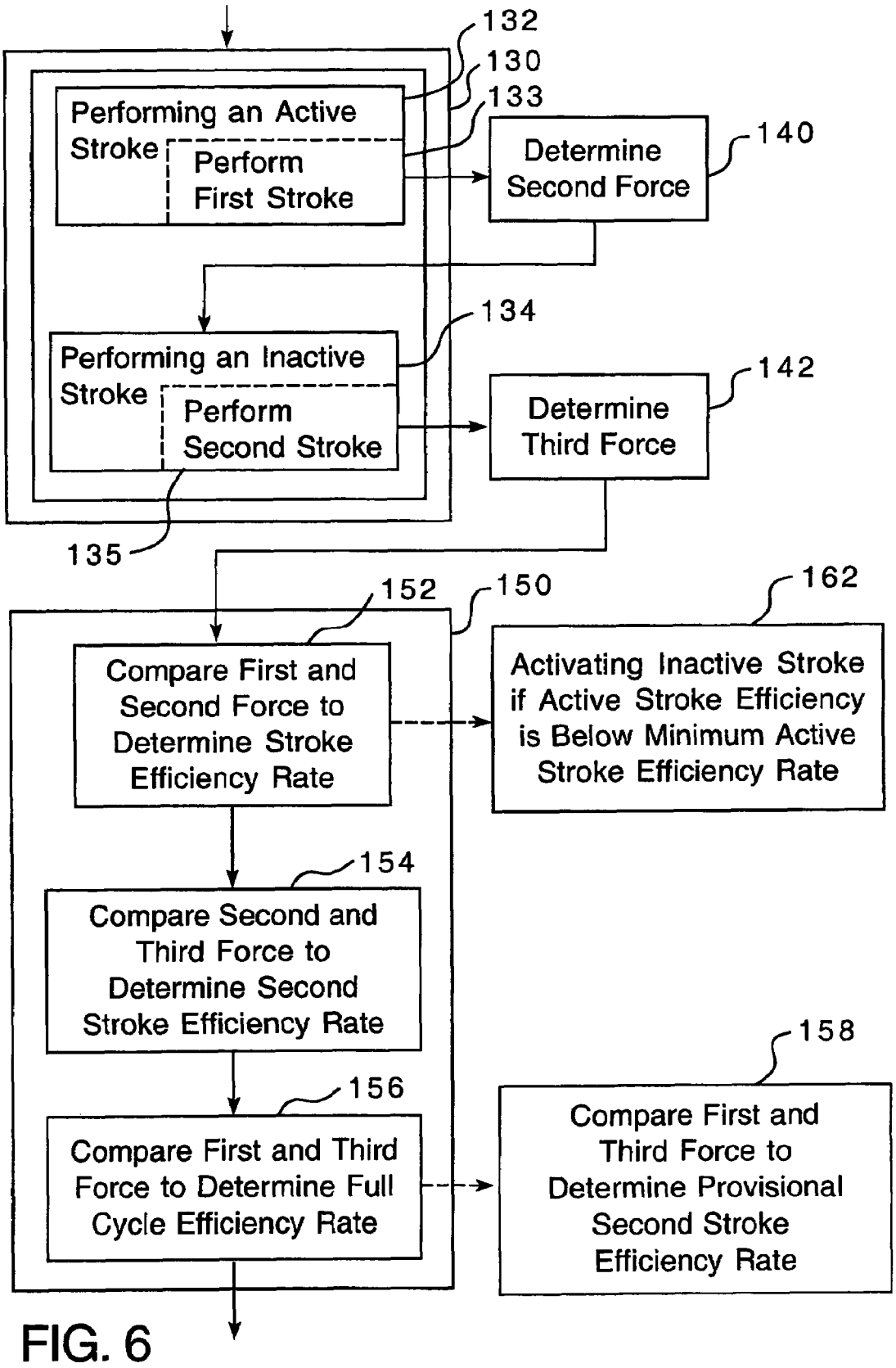
FIG. 6 is a flow chart showing sub-steps to the method provided.

As shown in FIG. 6, in a preferred embodiment, the force measured is the weight of the heat transfer elements 64. Additionally, in the preferred embodiment, the step of cleaning 130 includes the step of performing 131 a two stroke operation having a first stroke and a second stroke—that is, performing a first stroke 133 and performing a second stroke 135. Initially, only one of the strokes, either the first or the second stroke, is an active stroke. That is, the cleaning element 82 operates only during the active stroke and is disabled during the inactive stroke. Thus, there is a step of performing an active stroke 132 and performing an inactive stroke 134. In this embodiment, as before, a first force is determined 120 before the cleaning operation begins. The second force is determined 140 after the active stroke. The first and second forces are compared 152 to determine an active stroke efficiency rate. When the active stroke efficiency rate falls below the minimum active stroke efficiency rate, the step of managing 118 the cleaning system 80 or a cleaning element 82, may include the step of activating 162 the inactive stroke to provide additional cleaning.

In a more preferred embodiment, the active stroke occurs during the step of performing a first stroke 133. Thus, if the active stroke efficiency rate falls below the minimum active stroke efficiency rate during the first stroke, the second stroke may be immediately activated. Thus, in the more preferred embodiment, the second force is determined 140 after the first stroke. Additionally, a third force is determined 142 at the end of the second stroke. Thus, in this embodiment, by comparing 152 the first and second forces, a first stroke efficiency rate may be determined. Additionally, by comparing 154 the second and third forces, a second stroke efficiency rate may be determined. By comparing 156 the first and third forces, a full cycle efficiency rate may be determined.

The determination of the first stroke efficiency rate, a second stroke efficiency rate, and a full cycle efficiency rate may be used to manage 118 the cleaning system 80 in various ways. For example, if both first and second strokes are active, and the data reflects that the single stroke is removing a substantial amount of ash, one of the two strokes may be disabled. Once the single active stroke fails to remove a sufficient quantity of ash, the inactive stroke may be again activated. This process may be repeated.

Additionally, if the application of steam during the first stroke has been eliminated but steam is still being applied during the second stroke, the provisional second stroke efficiency rate may be determined by comparing 158 the first and third forces. If the provisional second stroke efficiency rate is below the minimum provisional second stroke efficiency rate, the application of steam during the second stroke may be eliminated 166 for a number of cleaning cycles. In the preferred embodiment, the step of managing 118 the cleaning system 80 or a cleaning element 82 may include the step of reactivating 170 the cleaning elements 82 after a period of time and the efficiencies are re-evaluated.

Figure 7:
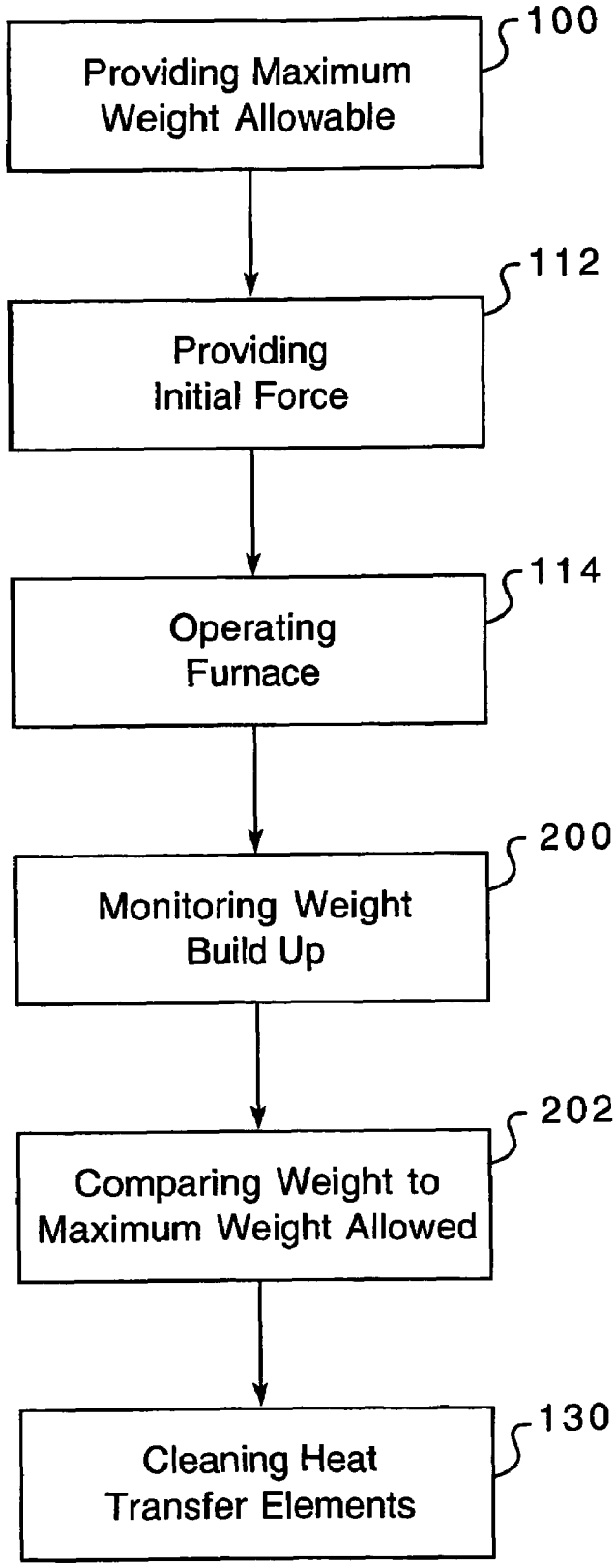
FIG. 7 is a flow chart of the showing the steps of the method of sootblowing based on the weight of deposit buildup.

As shown in FIG. 7, the boiler system 10 having a weighing system 94 may also be used to increase the efficiency of the cleaning system 80 by initiating cleaning based on the accumulated ash deposit as opposed to performing cleaning on a schedule. This method includes the steps of providing 100 the maximum weight of ash allowable on a heat transfer element 64 and providing 112 the initial force applied by the heat transfer element 64 on the support structure 70. During the operation 114 of the furnace 16, additional weight is added to the heat transfer elements 64 as ash is deposited thereon. The method further includes the step of monitoring 200 the weight build-up of the ash using the weighing system 94. The weight build-up of the ash is compared 202 to the maximum weight of ash allowable on that heat transfer element 64. When the weight of the ash on a heat transfer element 64 exceeds the maximum weight of ash allowable on that heat transfer element 64, the heat transfer element 64 is cleaned 130. The steps of monitoring 200 the weight buildup, comparing 202 the weight buildup of the ash to the maximum weight of ash allowable on that heat transfer element 64, and cleaning 130 the heat transfer element 64 may be repeated until the cleaning elements 82 no longer act in an efficient manner.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A method of cleaning at least one heat transfer element inside a boiler being supported by a support structure having a direct measurement weighing system for measuring a force exerted on the support structure by the at least one heat transfer element, the method comprising:

a) providing a cleaning system having at least one cleaning element configured to clean at least one of the at least one heat transfer element;

b) determining an efficiency rate for the at least one cleaning element through use of the direct measurement weighing system, wherein the determining of the efficiency rate comprising i) measuring the force exerted on the support structure by the at least one heat transfer element, ii) cleaning the at least one heat transfer element with the at least one cleaning element, iii) then, measuring the force exerted on the support structure by the at least one heat transfer element, and iv) comparing the force measured before and after said cleaning the at least one heat transfer element; and c) managing the cleaning system in real time based on the efficiency rate, the managing of the cleaning system comprising i) determining a most effective of the at least one cleaning element based on the efficiency rate on the at least one heat transfer element and operating the at least one cleaning element associated with the at least one heat transfer element based on the ranking, ii) adjusting the operation of the at least one cleaning element for cleaning the at least one heat transfer element to improve deposit removal, and iii) switching the at least one cleaning element from one-way to two-way operation depending on requirements for cleaning of the at least one heat transfer element and the effectiveness of the at least one cleaning element.

2. The method of claim 1, wherein the force is defined by a weight of the at least one heat transfer element.

3. The method of claim 2, wherein the force further includes the weight of ash on the at least one heat transfer element.

4. The method of claim 1, wherein the switching of the at least one cleaning element from one-way to two-way operation is defined by cleaning elements operating while inserting and retracting inside the boiler and wherein only inserting or only retracting is defined as the one-way operation.

5. The method of claim 4, wherein the cleaning of the at least one heat transfer element comprises first and second strokes wherein the first stroke is defined as the insertion of the cleaning elements and wherein the second stroke is defined as the retraction of the cleaning elements.

6. The method of claim 4, wherein the cleaning of the at least one heat transfer element comprises a single stroke and wherein the single stroke is defined by either insertion or retraction of the cleaning elements inside the boiler.

7. The method of claim 1, wherein the managing of the cleaning system comprises comparing a determined efficiency rate to a minimum efficiency rate and increasing a supply of steam provided to the at least one cleaning element far either a first or a second stroke if the determined efficiency rate is less than the minimum efficiency rate.

8. The method of claim 7, wherein to supply of steam is used for cleaning the at least one heat transfer element.

9. The method of claim 1, wherein the managing of the cleaning system comprises comparing a determined efficiency rate to a minimum efficiency rate and decreasing a supply of steam provided to the at least one cleaning element for either a first or a second stroke if the determined efficiency rate is greater than the minimum efficiency rate.

10. The method of claim 1, wherein the managing of the cleaning system comprises comparing a determined efficiency rate to a minimum efficiency rate and removing a supply of steam to the at least one cleaning element for either a first or a second stroke if the determined efficiency rate is equal to the minimum efficiency rate.

11. The method of claim 1, wherein the providing of the cleaning system comprises providing a plurality of cleaning elements.

* * * * *